US005138294A

United States Patent [19]

Yoshikawa

[11] Patent Number: 5,138,294

[45] Date of Patent: Aug. 11, 1992

[54] ELECTROMAGNETIC INDUCTION DEVICE

[75] Inventor: Toru Yoshikawa, Ako, Japan

[73] Assignee: Mitsubishi Denki Kabushiki Kaisha, Tokyo, Japan

[21] Appl. No.: 714,945

[22] Filed: Jun. 13, 1991

[30] Foreign Application Priority Data

Jun. 15, 1990 [JP] Japan ..... 2-62744[U]

[51] Int. Cl.[5] ..... H01F 27/08

[52] U.S. Cl. ..... 336/60; 174/16.1

[58] Field of Search ..... 336/55, 57, 59, 60; 174/16.1; 361/384, 385

[56] References Cited

U.S. PATENT DOCUMENTS

| | | | |
|---|---|---|---|
| 2,440,556 | 4/1948 | Paluev | 336/60 |
| 2,912,658 | 11/1959 | Paluev | 336/60 |
| 2,942,213 | 6/1960 | Camilli et al. | 336/60 |
| 3,032,728 | 5/1962 | Camilli et al. | 336/60 |
| 3,663,910 | 5/1972 | Grubb | 336/57 |
| 3,902,146 | 8/1975 | Muralidharan | 336/57 |
| 4,000,482 | 12/1976 | Staub et al. | 336/60 |
| 4,028,653 | 6/1977 | Carlsson et al. | 336/60 |
| 4,207,550 | 6/1980 | Daikobu et al. | 336/60 |
| 4,477,791 | 10/1984 | Thiel et al. | 336/60 |

FOREIGN PATENT DOCUMENTS

| | | | |
|---|---|---|---|
| 1513847 | 2/1970 | Fed. Rep. of Germany . | |
| 1563160 | 4/1970 | Fed. Rep. of Germany . | |
| 3341626 | 5/1985 | Fed. Rep. of Germany . | |
| 54-104529 | 8/1979 | Japan | 336/60 |
| 782130 | 9/1957 | United Kingdom . | |
| 887383 | 1/1962 | United Kingdom . | |

OTHER PUBLICATIONS

Soviet Inventions Illustrated Derwent Week B29, published 29 Aug. 1979, London & SU-A-626445.

Patent Abstracts Japan JP-A-58 107 615.

Patent Abstracts Japan JP-A-59 A1 818.

*Primary Examiner*—Thomas J. Kozma

*Attorney, Agent, or Firm*—Sughrue, Mion, Zinn, Macpeak and Seas

[57] ABSTRACT

An electromagnetic induction device has coils of a plurality of phases and a duct through which a cooling medium is introduced into the coils to cool them. Guides are provided in the duct so asd to realize a substantially uniform distribution of the cooling medium to all coils. The flow rates of the cooling medium through the coils is substantially uniformallized so that the coils exhibit substantially the same temperature rise. As a consequence, any difference in the life between the coils is substantially eliminated.

5 Claims, 2 Drawing Sheets

ELECTROMAGNETIC INDUCTION DEVICE

BACKGROUND OF THE INVENTION

1. Field of the Invention

The present invention relates to an electromagnetic induction device of the type in which coils of respective phases are cooled by a flow of a cooling medium composed of an insulating gas such as $SF_6$ gas. More particularly, the present invention is concerned with an electromagnetic induction device improved to equalize the flow rates of the cooling gas through the coils of all phases.

2. Description of the Related Art

FIG. 3 is a schematic sectional view of a 3-phase electromagnetic induction device as an example of conventional electromagnetic induction devices. Referring to this figure, a tank 1 accommodates coils 2A, 2B and 2C of A, B and C phases which form a major part of the electromagnetic induction device and which are illustrated schematically. These coils 2A, 2B and 2C will also be collectively referred to as coils 2. One end of a lower coolant pipe 3 is connected to and opens into a lower portion of the tank 1 so as to introduce a flow of a coolant to a space under the electromagnetic induction device. Upper coolant pipes 4, each connected at one end to a cooler (not shown), are connected at the other end to a top wall of the tank 1. A coolant duct 8 is defined between the bottom wall of the tank 1 and a partition plate 5. The partition plate 5 has openings which provides coolant inlets 5A, 5B and 5C for introducing the coolant to the coils 2A, 2B and 2C of the respective phases. In this known electromagnetic induction device, a flow of a coolant produced by a blower is supplied into the coolant duct 8 through the lower coolant pipe 3 and is then introduced, as indicated by arrows, into the coils 2A, 2B and 2C of the respective phases through the coolant inlets 5A, 5B and 5C formed in the partition plate 5, thereby to cool these coils 2A, 2B and 2C. The coolant after cooling the coils 2A, 2B and 2C is then introduced into the cooler through the upper coolant pipes 4. Thus, the flow of the coolant is forced by a blower into the coolant duct 8, and the flow of the coolant is distributed to the coils 2A, 2B and 2C. In the distributed coolant flow from the coolant duck 8 to respective coils 2A, 2B and 2C, a deceleration caused by a flow distribution of the coolant acts as a pressure buildup in the coolant, and a frictional pipe resistance acts as a pressure drop in the coolant. As a consequence, the coolant is distributed to the coils 2 unevenly such that the flow rate is smallest in the coil 2A of the phase A nearest to the lower coolant pipe 3 and greatest in the coil 2C of the phase C remotest from the lower coolant pipe 3.

The uneven distribution of the coolant to the coils 2A, 2B and 2C causes a difference in the rate of conveyance of heat from these coils to the cooler. Consequently, the coil 2A of the phase A in which the coolant flow rate is smallest may exhibit a temperature rise to a level exceeding the rated temperature. This promotes deterioration of the insulating material forming the coils 2 to shorten the life of the electromagnetic induction device.

SUMMARY OF THE INVENTION

Accordingly, an object of the present invention is to provide an electromagnetic induction device in which the flow rates of the coolant in the coils of all phases are equalized to ensure a uniform temperature rise of these coils, thereby overcoming the above-described problems of the prior art.

To this end, according to the present invention, there is provided an electromagnetic induction device comprising: a tank; a plurality of coils accommodated in the tank; a cooling medium introduced into the tank for cooling the coils; a duct defined in the tank for introducing the cooling medium into the coils; and guide means provided in the duct so as to realize a substantially uniform distribution of the cooling medium to the coils.

DESCRIPTION OF THE PREFERRED EMBODIMENTS

The invention will be more fully understood from the following description of the preferred embodiment.

Figure 1:
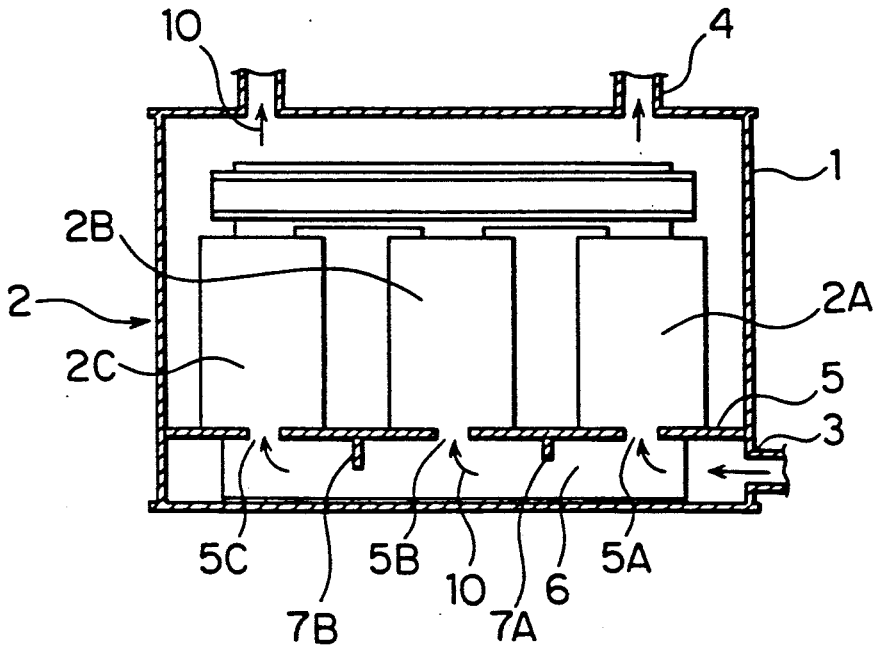
FIG. 1 is a schematic sectional view of an electromagnetic induction device in accordance with an embodiment of the present invention.
Figure 3:
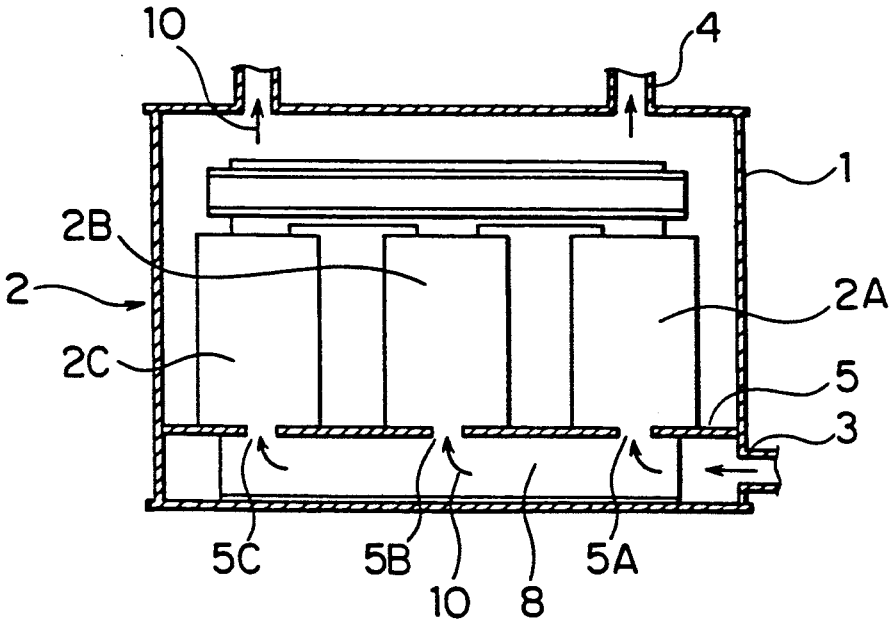
FIG. 3 PRIOR ART
FIG. 3 is a schematic sectional view of a conventional electromagnetic induction device.
Figure 4:
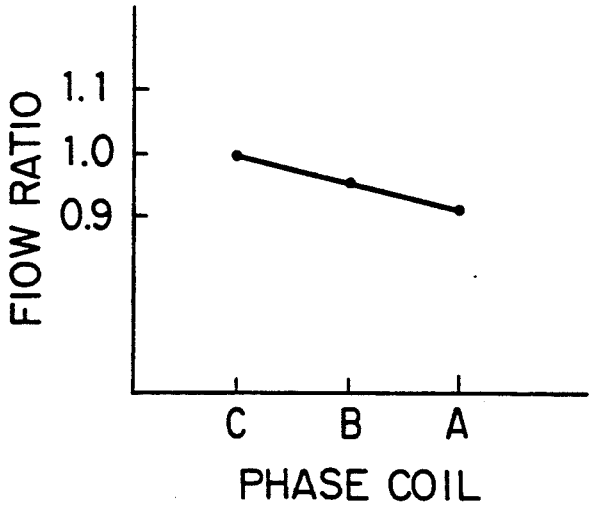
FIG. 4 PRIOR ART
FIG. 4 is a graph showing the flow rates of a coolant distributed to coils of respective phases of the conventional electromagnetic induction device shown in FIG. 3.

FIG. 1 is a schematic sectional view showing an embodiment of the electromagnetic induction device of the present invention. In this figure, the same reference numerals are used to denote the same parts or members as those appearing in FIG. 3 showing the conventional device, and detailed description of such parts or members is omitted.

A coolant duct 6 is defined between the bottom wall of a tank and a partition plate 5 which separates the duct 6 from the space accommodating the coils 2. A coolant which is preferably an insulating gas such as $SF_6$ gas for cooling the coils 2A, 2B and 2C of the respective phases is forced by a blower into the cooling duct 6.

The partition plate 5 is provided at its portions between the coolant inlets 5C and 5B and between the coolant inlets 5B and 5A with flow-rate regulating guides 7A and 7B. Although not exclusive, the flow rate regulating guides 7A, 7B may be baffle plates as illustrated. The dimensions or projecting lengths of the flow rate regulating guides are determined to realize a uniform distribution of the coolant to the coils 2. More specifically, the dimension of the flow rate regulating guide 7A is determined such that about one third ($\frac{1}{3}$) of the coolant supplied by the blower is introduced into the coil 2A of the phase A through the coolant inlet 5A, while two thirds ($\frac{2}{3}$) of the same are directed to the coils 2B and 2C of the phases B and C. Similarly, the dimension of the flow rate regulating guide 7B between the coolant inlets 5B and 5C is so determined that half ($\frac{1}{2}$) the amount of coolant which has passed over the flow rate regulating guide 7A, i.e., one third ($\frac{1}{3}$) of the total amount supplied by the blower, is introduced into the coil 2B through the coolant inlet 5B and the remaining half, i.e., one third ($\frac{1}{3}$) of the total amount, is introduced into the coil 2C through the coolant inlet 5C.

Figure 2:
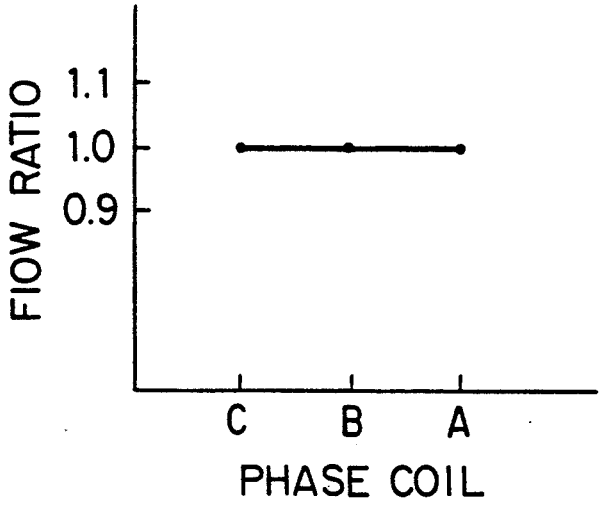
FIG. 2 is a graph showing the flow rates of a coolant distributed to coils of respective phases of the electromagnetic induction device shown in FIG. 1.

Thus, in the electromagnetic induction device of the present invention, the flow rate regulating guides 7A, 7B provided in the coolant duct 6 function as flow resistors which impose resistance to the flow of the coolant, so as to enable the coolant to be supplied substantially uniformly into the coils 2A, 2B and 2C, as will be seen from FIG. 2. Consequently, any difference in temperature between the coils 2A, 2B and 2C of the respective phases is substantially eliminated.

In the illustrated embodiment, the flow rate regulating guides 7A and 7B are attached to the partition plate 5 which forms an upper wall of the duct 6. This, however, is only illustrative and the flow rate regulating guides may be provided at any suitable positions where they can realize the substantially uniform distribution of the coolant, e.g., on the bottom wall of the tank 1 facing the duct 6.

As will be understood from the foregoing description, in the electromagnetic induction device of the present invention, flow rate regulating means are provided to realize a substantially uniform distribution of the coolant to the coils of the respective phases, by virtue of the flow rate regulating guides provided in the coolant duct. As a result, all the coils exhibit substantially the same temperature rise, thus contributing to prolongation of the life of the device.

What is claimed is:

1. A three-phase electromagnetic induction device, comprising:

a) a tank (1), b) a partition plate (5) extending across a lower portion of the tank and defining, with a bottom wall and side walls of the tank, a gaseous coolant duct (6) of uniform cross-section, c) three cylindrical coils (2A, 2B, 2C) disposed within the tank, in a row, above the partition plate, and having vertically oriented axes, d) three coolant flow apertures (5A, 5B, 5C) individually defined in the partition plate below the respective coils, a coolant in said tank for cooling said coils, e) a coolant inlet (3) at one end of the duct, f) coolant outlet means (4) in an upper portion of the tank, and g) a pair of baffle plates (7A, 7B) individually disposed between adjacent coolant flow apertures and extending inwardly of the duct, said baffle plates having different surface areas to establish a substantially uniform distribution of coolant to the respective coils.

2. An electromagnetic induction device according to claim 1, wherein a baffle plate farthest from the coolant inlet has a surface area larger than that of a baffle plate closest to the coolant inlet.

3. An electromagnetic induction device according to claim 2, wherein said baffle plates are provided on and extend downwardly from the partition plate.

4. An electromagnetic induction device according to claim 2, wherein said baffle plates are provided on and extend upwardly from the bottom wall of said tank.

5. An electromagnetic induction device according to claim 1, wherein said coolant is sulfur hexafluoride.

* * * * *